US006007388A

United States Patent [19]

Kooiman

[11] Patent Number: 6,007,388

[45] **Date of Patent: *Dec. 28, 1999**

[54] DOUBLE-ENDED CANTILEVERED BEAM SPRING CONTACT

[75] Inventor: John Kooiman, Lockport, Ill.

[73] Assignee: Andrew Corporation, Orland Park, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/859,755

[22] Filed: May 21, 1997

[51] Int. Cl.[6] ..... H01R 13/05

[52] U.S. Cl. ..... 439/825

[58] Field of Search ..... 439/578, 675, 439/825, 851

[56] References Cited

U.S. PATENT DOCUMENTS

| | | | |
|---|---|---|---|
| 2,036,759 | 4/1936 | Kleinmann | 439/825 |
| 4,071,876 | 1/1978 | Benson et al. | 361/119 |
| 4,460,234 | 7/1984 | Bogese | 339/128 |
| 4,662,706 | 5/1987 | Foley | 339/256 R |
| 4,685,886 | 8/1987 | Denlinger et al. | 439/55 |
| 5,015,195 | 5/1991 | Piriz | 439/825 |
| 5,118,979 | 6/1992 | Shih et al. | 310/214 |
| 5,147,229 | 9/1992 | Nestor | 439/843 |
| 5,326,288 | 7/1994 | Lu et al. | 439/851 |
| 5,362,251 | 11/1994 | Bielak | 439/394 |
| 5,410,257 | 4/1995 | Swaffield | 324/755 |
| 5,449,304 | 9/1995 | Huss, Jr. et al. | 439/843 |
| 5,489,854 | 2/1996 | Buck et al. | 324/761 |
| 5,518,420 | 5/1996 | Pitschi | 439/825 |

FOREIGN PATENT DOCUMENTS

| | | | |
|---|---|---|---|
| 436173 | 10/1935 | United Kingdom . | |
| 1317393 | 5/1973 | United Kingdom | H01K 1/46 |
| 1492764 | 11/1997 | United Kingdom | H01R 3/02 |

*Primary Examiner*—Neil Abrams
*Assistant Examiner*—Javaid Nasri
*Attorney, Agent, or Firm*—Arnold White & Durkee

[57] ABSTRACT

A one-piece electrical connector for corrugated conductors, such as used in radio frequency high power coaxial transmission lines, is disclosed. The connector has a straight, tubular center section that is supported on both ends by inwardly projecting beams which are supported at their outer ends. The connector is comprised of a spring material, such as beryllium copper or phosphor bronze, for a spring type force fit into the corrugated conductor.

13 Claims, 1 Drawing Sheet

DOUBLE-ENDED CANTILEVERED BEAM SPRING CONTACT

FIELD OF THE INVENTION

This invention relates generally to electrical connectors and more specifically to contacts for radio frequency high power coaxial transmission lines.

BACKGROUND OF THE INVENTION

To increase the flexibility of radio frequency (RF) high power coaxial transmission lines, the electrical conductors for the lines are often corrugated, i.e., fabricated with periodic annular or helical deformations. The uneven surface of such corrugations, however, makes obtaining a uniform electrical contact with connector components difficult to achieve. Prior art connectors for such corrugated transmission lines have required multiple pieces, involving a screw-in, clamping or expanding-anchor type design. Such designs, however, are costly to construct and difficult to employ.

SUMMARY OF THE INVENTION

I have discovered an electrical connector or contact that affords a stable, uniform electrical contact with a corrugated transmission line, like the transmission lines often used for radio frequency high power coaxial transmission lines. The contact is preferably one-piece, and therefore less expensive to construct, and easier to use, than multi-piece prior art connectors.

The contact of this invention has a generally straight, cylindrical or tubular, center contact section, which is sufficiently long to span or extend across at least one complete corrugation when the connector is inserted into a corrugated conductor. The contact section is supported on both ends by inwardly projecting beams, which are supported at their outer ends, and which are preferably tapered or angled. At least the beams, and preferably the entire connector, are comprised of a spring material, such as for example, phosphor bronze or beryllium copper, for a spring-type fit into the corrugated conductor. The dual beams enable the connector, and particularly the contact section, to maintain straightness, concentricity and uniform contact pressure when inserted into a corrugated conductor.

DETAILED DESCRIPTION OF THE INVENTION

The electrical contact or connector of this invention offers faster and easier assembly, more uniform contact, and improved performance and stability, when used in connections for radio frequency high power coaxial transmission lines, than connectors known in the art. The advantages of this invention are obtained by the unique features of the connector.

Figure 1:
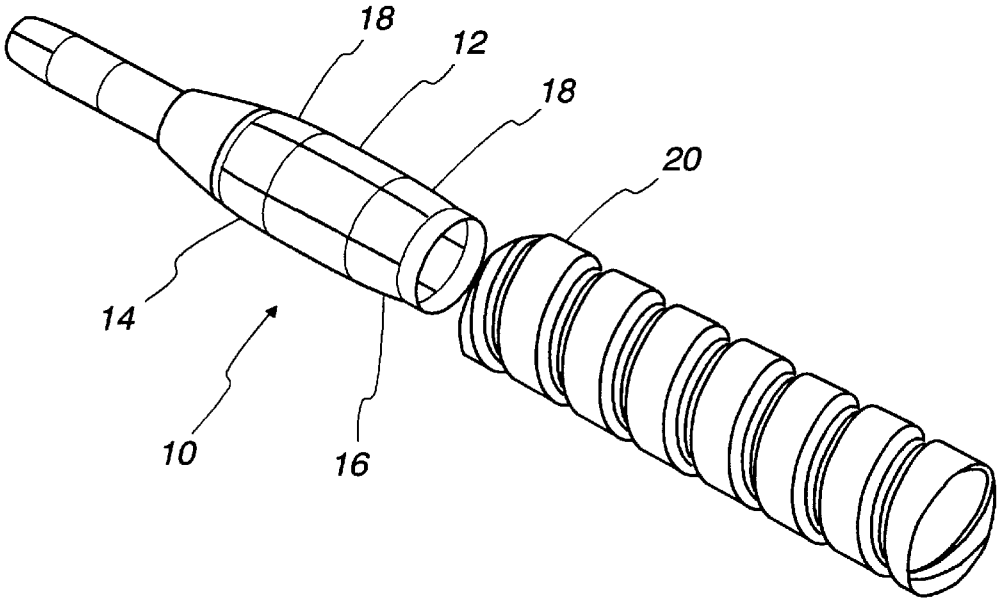
FIG. 1 depicts a side view of a spring contact of this invention and a corrugated conductor assembly.

Referring to FIG. 1, for example, a contact 10 has a center section 12, comprised of any material with electrical properties suitable for the purposes of the connector. Usually, non-magnetic materials are preferred to avoid magnetic interference with electrical performance and intermodulation distortion. Section 12 is generally straight, and tubular or cylindrical in shape, with a hollow interior. Section 12 is preferably sufficiently long to extend across or span at least one complete corrugation of the corrugated conductor 20, and a plurality of circumferentially spaced, longitudal extending slits 19.

The front end 14 and the rear end 16 of connector 10 are supported by inwardly projecting beams 18, which are supported at their outer ends and which are tapered or angled. These beams are comprised of any material with sufficient strength to have spring-like qualities and most preferably are comprised of the same material as, and in one piece with, center section 12. Phosphor bronze and beryllium copper are examples of materials particularly suitable for contact 10.

Figure 2:
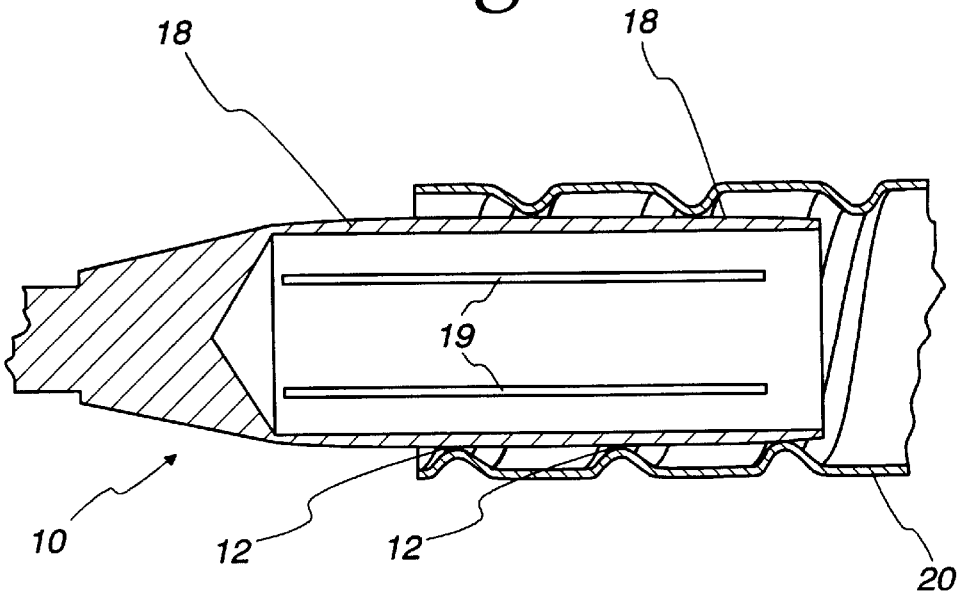
FIG. 2 depicts a cross-section of a spring contact of this invention fitted into the corrugated conductor assembly of FIG. 1.

When the contact 10 is inserted or fitted into the corrugated conductor 20, as shown in FIG. 2, the beams 18 of connector 10 produce a tapered, or gradually increasing, spring force for a high force spring fit. Center section 12 spans across at least one complete corrugation of the corrugated conductor 20 and provides uniform contact pressure against the conductor 20. The beams 18 at both ends 14 and 16 support the center section 12 so the center section can maintain straightness and concentricity in the conductor 20. An insulator may be added behind the beams 18 at end 14 to further support and control the axial position of the contact. However, the addition of such insulator is not necessary to achieve the full benefits of the invention.

The principle of the invention and the best mode contemplated for applying that principle have been described. It is to be understood that the foregoing is illustrative only and that other means and techniques can be employed without departing from the true scope of the invention defined in the following claims.

I claim:

1. A connector for making an electrical connection with an inner surface of a corrugated conductor of a radio frequency transmission line, said connector comprising:

a generally straight, hollow, cylindrical center section having a uniform outer diameter long enough to span at least one complete corrugation of said corrugated conductor, and having a front end and a rear end, said center section having a plurality of longitudinally extending slits, inwardly projecting beams, supported at their outer ends, at each end of said center section for supporting said center section, and said center section and said beams producing a tapered, gradually increasing spring force against the inner surface of the conductor as the connector is inserted into the conductor for a high force spring fit against the inner surface of the conductor for carrying radio frequency signals.

2. The connector of claim 1 wherein said beams are comprised of a spring material.

3. The connector of claim 2 wherein said beams are comprised of a beryllium copper material or a phosphor bronze material.

4. The connector of claim 3 wherein said beams are formed in one piece with the center section.

5. The connector of claim 1 wherein said beams are formed in one piece with the center section.

6. The connector of claim 1 wherein said center section has a uniform inside diameter.

7. A connector-conductor assembly for carrying radio frequency signals comprising:

a conductor for carrying radio frequency signals, said conductor having a corrugated portion defining a corrugated inside surface; and a connector comprising:

a hollow, straight cylindrical center section having a uniform outer diameter long enough to span at least one complete corrugation of said corrugated conductor, and having a front end and a rear end, said center section having a plurality of longitudinally extending slits, and inwardly projecting beams, supported at their outer ends, at each end of said center section for supporting said center section;

said connector fitting inside said corrugated inside surface to produce a tapered, gradually increasing, spring force as the connector is inserted into the conductor for a high force spring fit with said corrugated inside surface.

8. The connector-conductor assembly of claim 7 wherein said center section and said beams are formed in one piece.

9. The connector-conductor assembly of claim 8 wherein said connector is comprised of a beryllium copper material or a phosphor bronze material.

10. The connector of claim 7 wherein said center section has a uniform inside diameter.

11. A connector-conductor assembly for carrying radio frequency signals; said assembly comprising:

a conductor having a hollow, generally tubular corrugated conductor portion, defining a corrugated inside surface, a connector having a generally hollow, cylindrical center section having a uniform outer diameter long enough to span at least one complete corrugation of said corrugated conductor, and having a front end and a rear end, and a plurality of longitudinally extending slits, inwardly projecting beams, supported at their outer ends, at each end of said center section for supporting said center section, and said connector fitting said corrugated conductor potion with a tapered, gradually increasing spring force as the connector is inserted into the conductor for a high force spring fit between said connector and said inside surface of said corrugated conductor portion.

12. The connector of claim 11 wherein said center section has a uniform inside diameter.

13. A method for making a radio frequency connection to a corrugated conductor for carrying radio frequency signals, said conductor having a corrugated inside surface, said method comprising the following steps:

providing a connector, aligning an end part of said connector with an end part of said conductor, and inserting said connector into said conductor so that said connector is engaged with said inside surface with a tapered, gradually increasing spring force for a high force spring fit between said connector and said inner surface, said connector having a straight, cylindrical center section having a uniform outer diameter long enough to span at least one complete corrugation of said corrugated conductor.

* * * * *